United States Patent [19]

Fegley et al.

[11] 3,957,012

[45] May 18, 1976

[54] ANTI-BURGLARY SOUND EMITTING DEVICE

[76] Inventors: Charles R. Fegley, 1606 Frush Valley Road, Laureldale, Pa. 19605; Werner F. Esseluhn, 12 Larchwood Road, Wyomissing, Pa. 19610

[22] Filed: Dec. 6, 1974

[21] Appl. No.: 530,094

[52] U.S. Cl. ..... 116/6; 116/81; 116/85; 116/112; 222/192

[51] Int. Cl.[2] ..... G08B 13/08; B67D 5/32

[58] Field of Search ..... 116/86, 85, 81, 75, 116/67 R, 6, 99, 75, 112; 222/399, 192; 109/44, 38, 29

[56] References Cited

UNITED STATES PATENTS

| | | | |
|---|---|---|---|
| 2,541,770 | 2/1951 | Lawrence | 116/75 |
| 2,570,438 | 10/1951 | Flagge et al. | 116/81 |
| 2,626,586 | 1/1953 | Mendes | 116/67 R |
| 3,000,344 | 9/1961 | Ferrell | 116/112 |
| 3,804,053 | 4/1974 | Gray | 116/86 |

*Primary Examiner*—Richard C. Queisser
*Assistant Examiner*—Daniel M. Yasich

[57] ABSTRACT

An anti-burglary sound emitting device in which a pressurized fluid is discharged to audibly oscillate a diaphram to create a warning signal when an intruder opens a window or door to enter an area unauthorized to the intruder. The anti-burglary device employs a spring biased pressurized container for discharging a fluid through a passageway and diaphram valving structure. A mechanical trigger for releasably retaining a pressurized container in cocked position and for releasing the slidably mounted pressurized container to cause sound is described.

11 Claims, 17 Drawing Figures

FIGURE 15
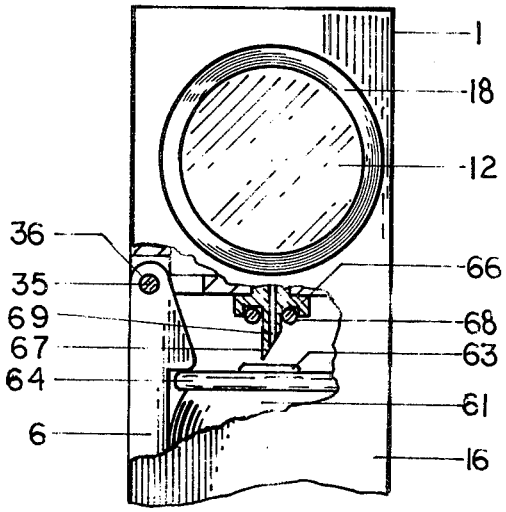
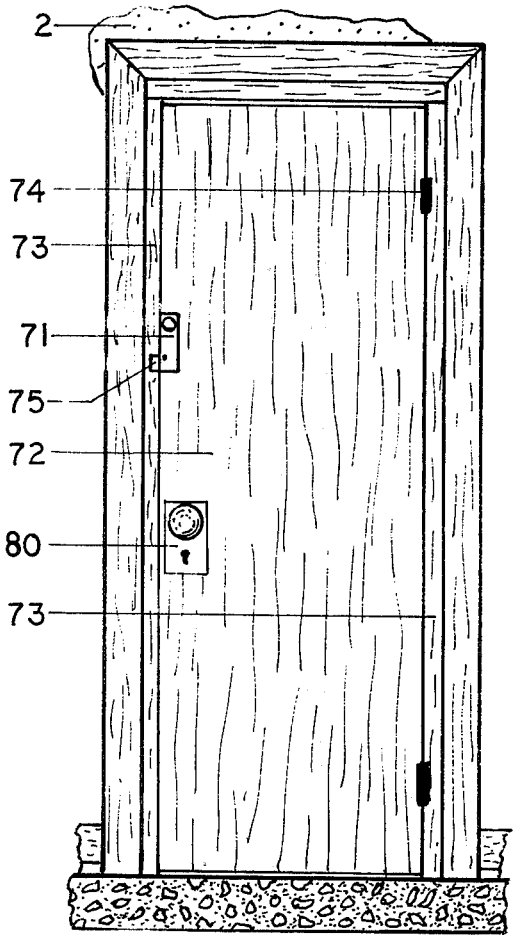
FIGURE 16
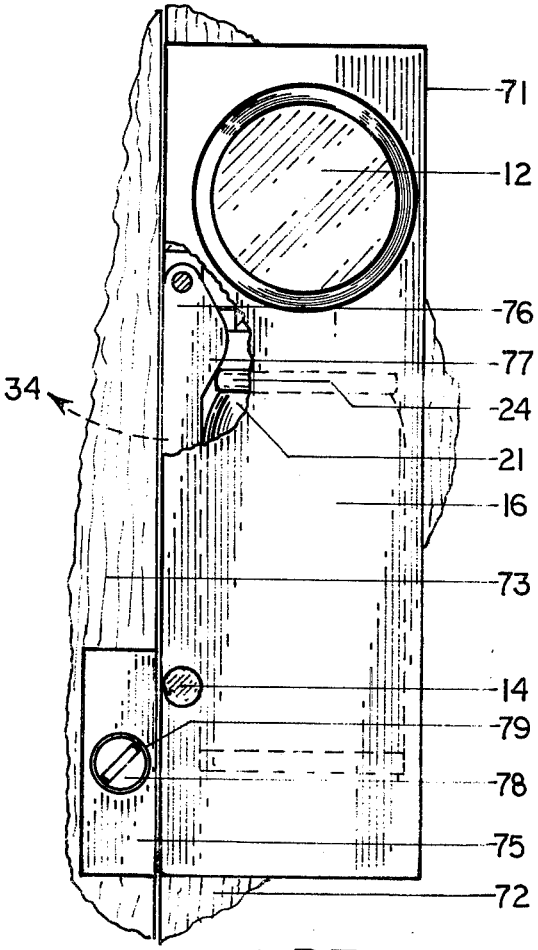
FIGURE 17

ANTI-BURGLARY SOUND EMITTING DEVICE

BACKGROUND OF THE INVENTION

The invention relates generally to an anit-burglary device and more particularly to a device which discharges a fluid from a pressurized container, one type of which is an aerosol container, through a sound emitting diaphram valve, thereby providing an audible alarm upon actuation by an unauthorized person and thereby alerting all persons in the protected area and thereby also provoking evacuation of that area by the intruder; but the invention is not limited to the use of the aerosol type container nor limited in use to anti-burglary applications. Its application is possible anyplace where mechanical actuation only is either desired or required.

Fluid, generally gaseous operated audible alarm or warning devices have been known in the art for many years. One type is the conventional whistle which generally requires an external pressurized fluid source such as pressurized steam or air. Other types are air operated diaphram horns such as found on vehicles, particularly trucks requiring either a vacuum, or pressure source. There are also known in the art fluid operated diaphram horns using aerosol type pressurized fluid containers as an operating source but all of these are manually operated requiring both the full attention and muscular forces of the operating person for actuation.

Thus what is needed is an anti-burglary sound emitting device, which can be fired by a relatively small amount of mechanical force initiated by various means connected or relative to the devices mechanically advantaged trigger element even though the device employs a relatively heavy spring for actuating the pressurized fluid container against an entry section of a fluid passageway with sufficient force to release the fluid through the fluid passageway to the sound emitting diaphram valve from the pressurized container, but which device is positively secured against accidental release until triggered by a motion caused by an unauthorized movement of an object such as a window, door, etc. and which will release sufficient fluid to emit sound from the device for a sufficient period of time to provoke action in response to the sound emitted.

SUMMARY OF THE INVENTION

The principal object of the present invention is to provide an anti-burglary device of the sound emitting type which may be triggered directly by a small amount of force, either applied or removed, and yet is positively secured against accidental release.

A further object of the invention is to provide a device of the sound emitting type which is readily triggered by a cord connecting the device triggering means to a window, door or other objects which might be moved by an intruder, unauthorized person or other means.

A further object of the invention is to provide a device of the sound emitting type for anti-burglary and other applications having means for reloading the device and resetting the triggering element of the device in its cocked position after it has been triggered.

According to the principle aspect of the present invention there is provided an inproved means for releasably retaining a spring biased pressurized fluid container slidably mounted in a cavity containing an entry section of fluid passageway which leads to a diaphram cavity. A cord, cable, wire or the like connects the trigger element to a window, door or other object which might be moved by an unauthorized person or other means in the area from which it is desired to restrict those persons. The trigger element releasably retains the slideably mounted spring biased pressurized gas container in shouldered engagement, thereby retaining the pressurized container in its cocked position and requiring positive force for release. When the window, door or other object associated with the device is moved by an unauthorized person, the cord connected to the trigger element moves the latter from shouldered engagement, thereby releasing the slideably mounted pressurized fluid container and permitting said container to be thrust toward the entry section of the passageway by the force of the spring associated with the container and causing said container to discharge its fluid through the passageway and through the sound emitting diaphram valve, the oscillations of the diaphram caused by the buildup and sudden release of fluid in the gas expanding diaphram cavity thereby causing other loud emission of audible sound.

Since the trigger element, which serves to retain the container in its cocked position, is movably mounted having a mechanical advantage, a relatively small amount of force is required to move the trigger element from shouldered engagement with said container and discharge said container, even though a relatively strong spring is employed for forcing said container into the entry section of the passageway to cause fluid discharge through the passageway. As a consequence, the cord connected to the trigger will not break as a result of triggering the device. The resistance to movement of the cord due to its connection to the trigger element is sufficiently low so as not to be noticeable. Nevertheless, the trigger element serves to retain the container safely in its cocked position preventing accidental release.

Alternatively, a latch plate may be used in releasable engagement with a self-camming trigger element such that the latch plate retains the self-camming trigger element which is shaped such as to be self-camming from the pressure exerted on the trigger element by the spring-biased container. When the latch plate is moved away from the device, or the device is moved away from the latch plate, the self-camming trigger element is free to be moved out of the way thereby allowing the spring biased pressurized fluid container to be thrust toward the entry section of the passageway, discharging the fluid as previously described.

The trigger element is shaped so as to exert only a small amount of force on the latch plate which can nevertheless retain the trigger element safely against accidental release from mechanical shock. The resistance to movement of the trigger element on the latch plate is sufficiently low so as not to be easily detected as the device is moved away from the latch plate's trigger element retaining position, or if the latch plate is moved away from the device.

The anti-burglary sound emitting device of the fluid operated type of the present invention may be utilized in homes, factories, farms, office buildings by connecting the cord attached to the trigger element to doors, windows, machinery, appliances, etc. or may be used in different forms with a latch plate in similar applications. The device may also be used as signaling device for beyond limit movements of equipment, equipment functions, etc. The device may be further utilized to signal or warn inhabitants of an area to unauthorized entries to the area protected by the device.

Once triggered, the device cannot be turned off by anyone and the entire amount of pressurized fluid is discharged whereupon the sound emissions diminish and cease. By further using a fluid which is also a dispersable irritant such as tear-gas the device can also serve to provoke immediate evacuation of the protected area.

Other objects, aspects and advantages of the invention will become apparent from the following description taken in connection with the accompanying drawings.

BRIEF DESCRIPTION OF THE DRAWINGS

FIG. 15 is a partial vertical sectional view along line B—B of FIG. 4 except showing a third embodiment of the device.

FIG. 16 is an elevational view of a wall, door and door frame showing the mounting of a fourth embodiment of the device.

FIG. 17 is a front elevational view similar to FIG. 3 including a partial vertical sectional view similar to FIG. 7 showing the fourth embodiment feature of the anti-burglary sound emitting device.

DESCRIPTION OF THE PREFERRED EMBODIMENTS

Figure 1:
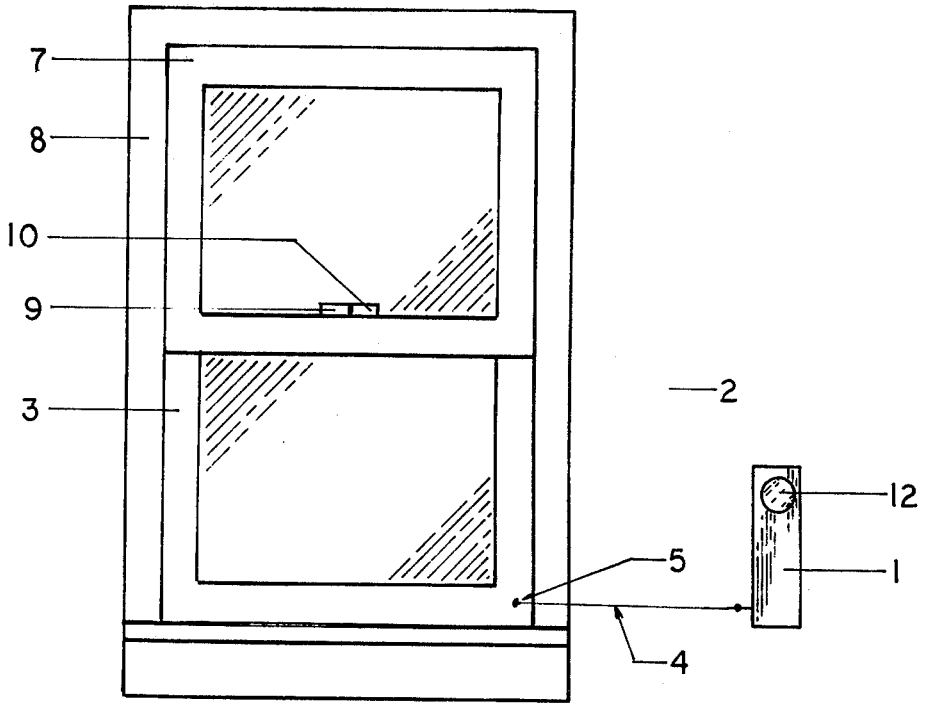
FIG. 1 is an elevational view of a wall having one embodiment of the anti-burglary sound emitting device of the present invention secured to a wall and mechanically connected with a cord to a window.
Figure 2:
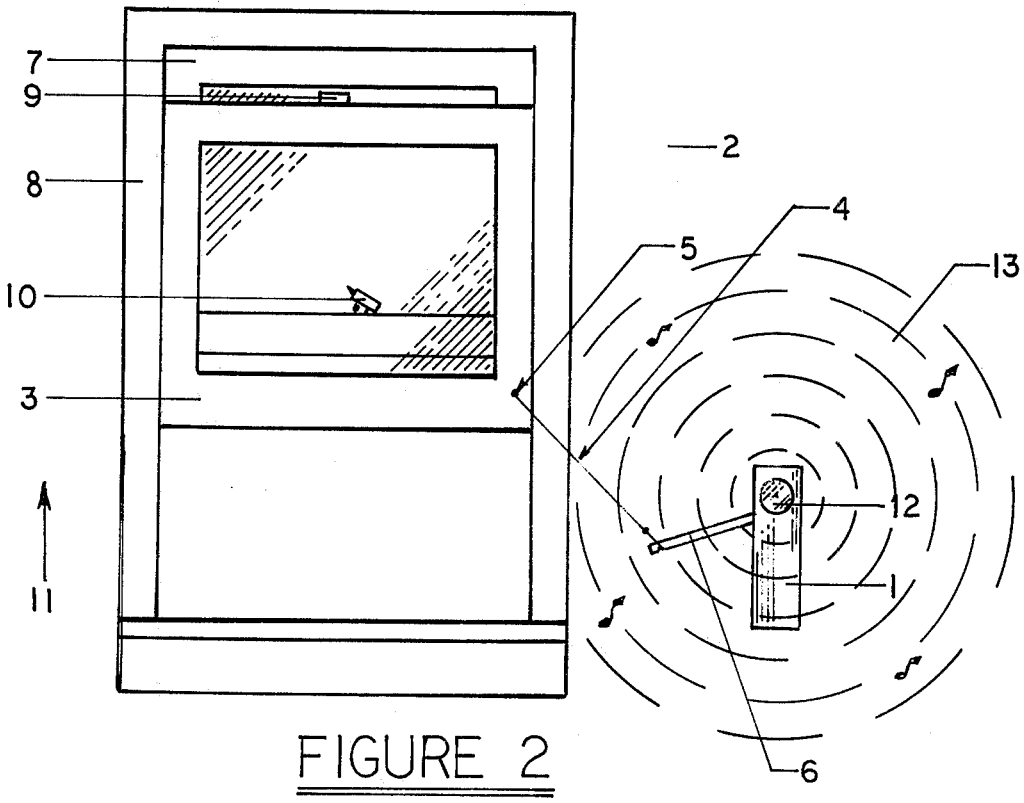
FIG. 2 is an elevational view similar to FIG. 1 but showing the window open, having triggered the device with the cord and emitting sound.
Figure 5:
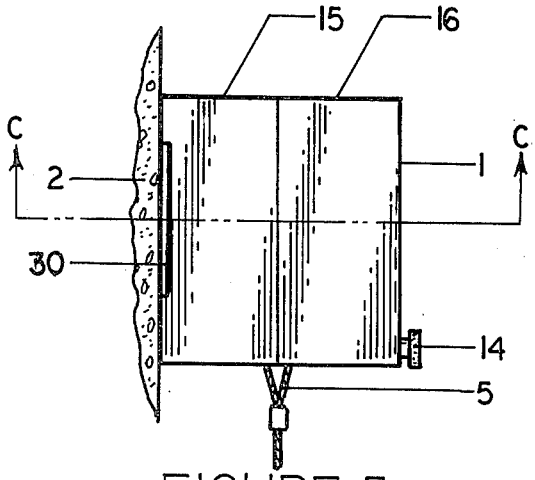
FIG. 5 is a top elevational view of the device showing the triggering cord, safety pin and fluid escape ports.
Figure 6:
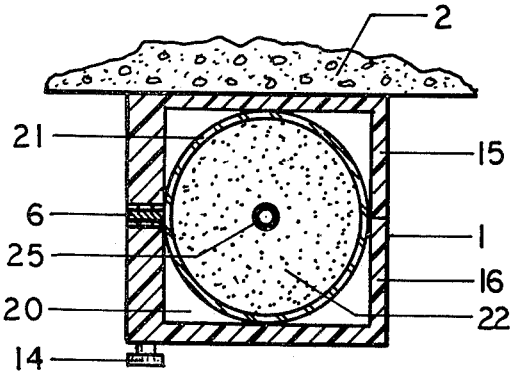
FIG. 6 is a horizontal sectional view taken along line A—A of FIG. 3.
Figure 4:
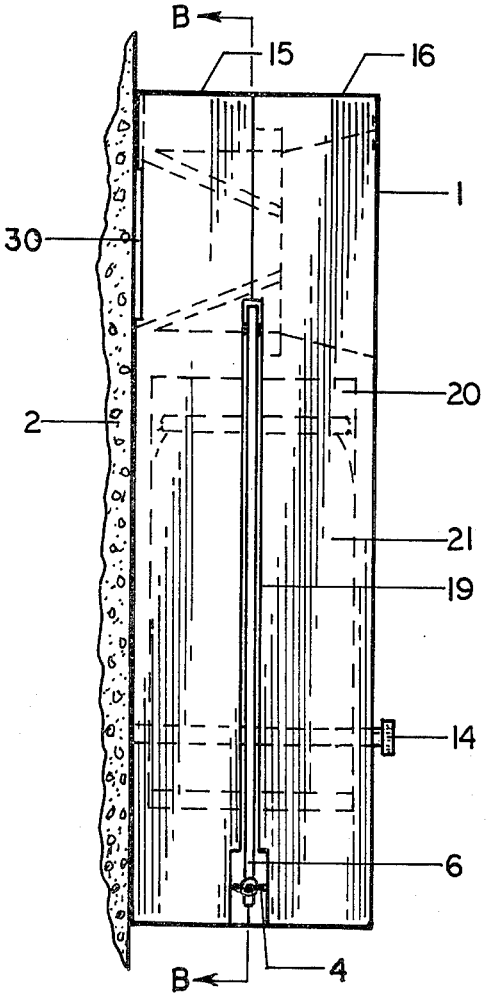
FIG. 4 is a side elevational view of the device.
Figure 3:
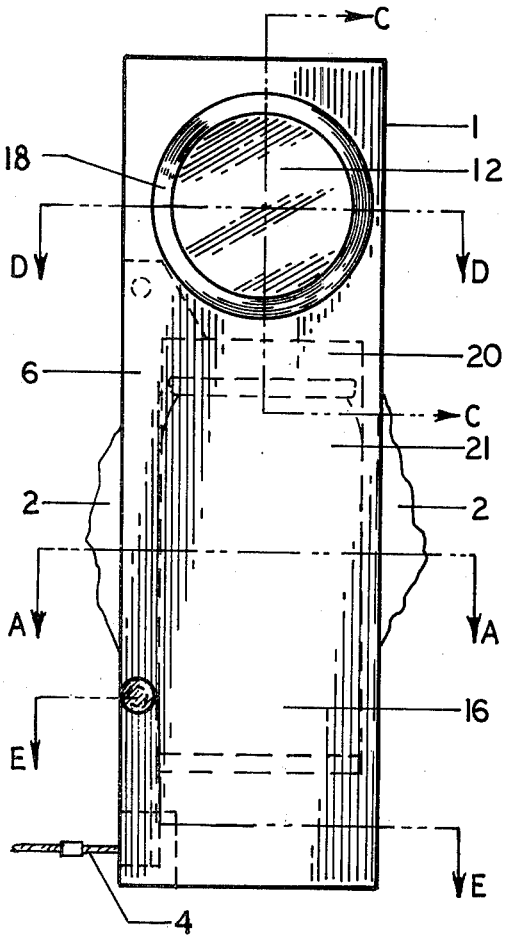
FIG. 3 is a front elevational view of the anti-burglary sound emitting device, showing the sound emitting diaphram and safety pin.
Figure 9:
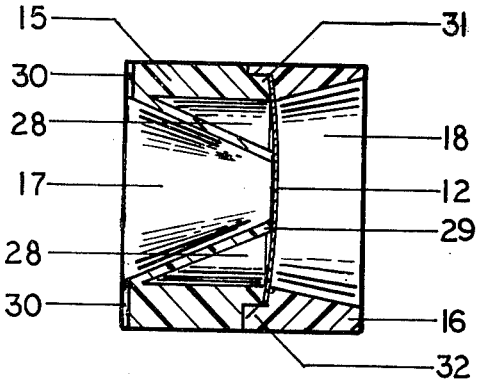
FIG. 9 is a horizontal sectional view along line D—D of FIG. 3.

Referring now to the drawings in detail, wherein like reference characters designate like parts throughout the various views, there is shown in FIGS. 1–13 one form of the anti-burglary sound emitting device, called device hereafter, of the fluid operated type according to the present invention, generally designated 1. The device 1 is secured to a wall 2 and connected by means of a cord 4 to a fastener 5 on window sash 3 of window frame 8 mounted in wall 2 as shown in FIG. 1 so that upon opening of the sash 3 by a burglar or other intruder the device will be triggered as shown in FIG. 2. The device whose front is shown in FIG. 3 comprises of an aerosol fluid container 21 slideably mounted in a body member shown as being comprised of a front body half 16 and back body half 15. The body halves 15 and 16 when assembled provide two flat sides, the back and right side, for mounting the device 1 to the wall 2 adjacent to window frame 8 or elsewhere.

The type of pressurized fluid container shown is of the aerosol type, but the invention is not limited to this type of container.

Figure 8:
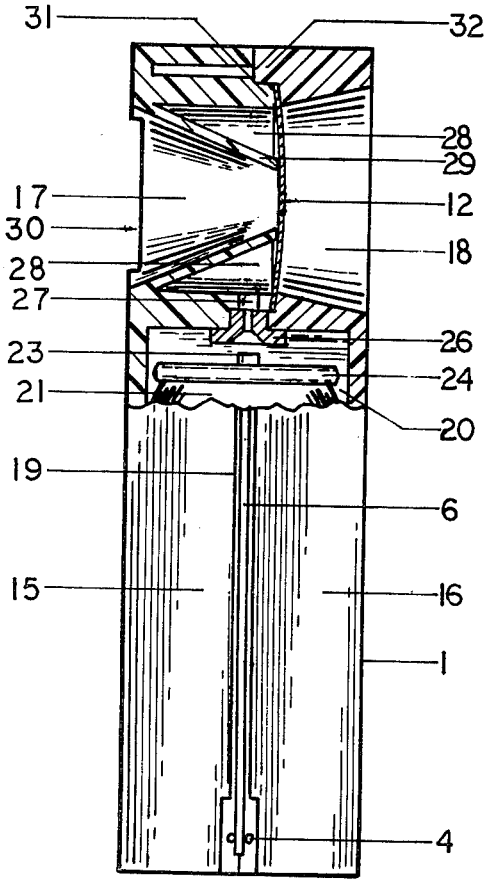
FIG. 8 is a partial vertical sectional view taken along lines C—C of FIGS. 3 and 5.
Figure 7:
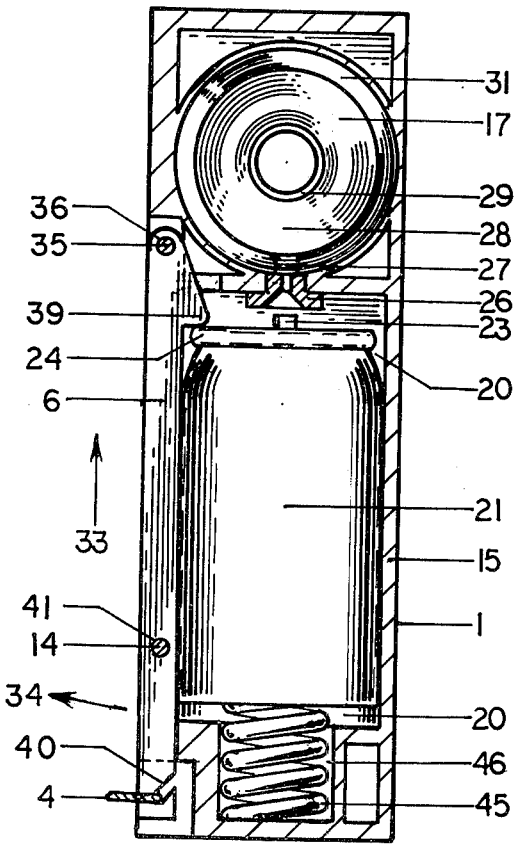
FIG. 7 is a vertical sectional view taken along line B—B of FIG. 4.
Figure 13:
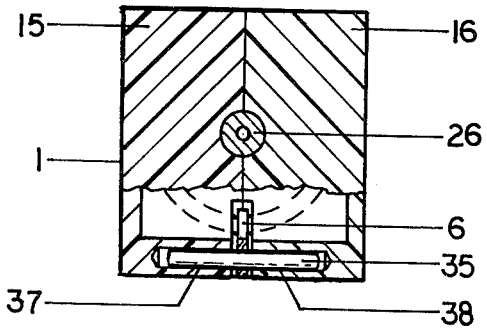
FIG. 13 is a horizontal sectional view along line F—F of FIG. 11.

Now referring to FIGS. 7 through 14 and best seen in FIGS. 7 and 8 the pressurized container cavity 20 is formed when the back and front body halves 15 and 16 are joined together by conventional means such as screws, snap together, ultrasonic welding, etc. Similarly formed and coaxial with the pressurized container cavity 20 are the spring cavity 46 and the entry section 26 of the fluid passageway 27. The fluid passageway 27 is a part of the back body half 15 located in the diaphram clamping projection 31 of the back body half 15.

Figure 12:
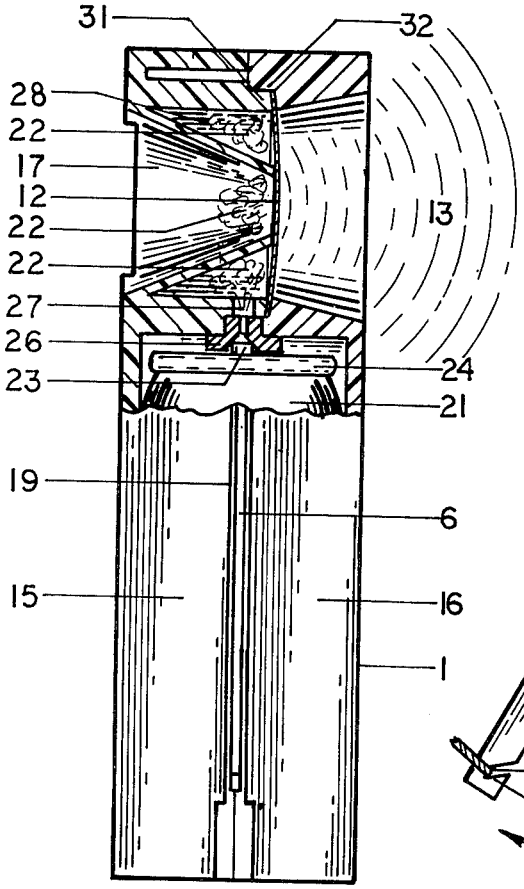
FIG. 12 is a partial vertical sectional view along lines C—C of FIGS. 3 and 5 similar to FIG. 8 except showing the device in the triggered condition of FIGS. 2 and 11.
Figure 11:
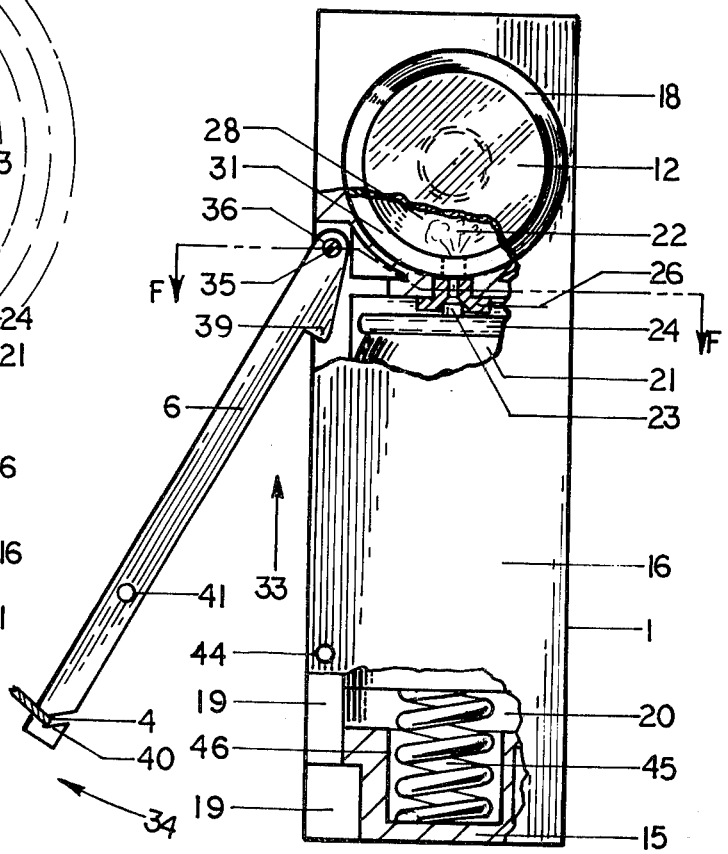
FIG. 11 is a partial vertical sectional view along line B—B of FIG. 4 similar to FIG. 7 except showing the device in the triggered condition also shown in FIG. 2.

The pressurized fluid container 21 hereafter referred to as container 21 slideably retained in cavity 20 such that spring 45 exerts force and thereby moves container 21 in direction 33 that causes projecting dispensing spout 23 to seat into entry section 26 which is in alignment with gas passageway 27. The material used for dispensing spout 23 is relatively soft and therefore effects an adequate seal with the entry section 26 to retain the fluid pressures normally used in the container 21. The alignment of entry section 26 with the passageway 27 assures an easy passage for fluid into the fluid expansion cavity 28. The container 21 in the position illustrated in FIGS. 11 and 12 is in its released and discharging position with the dispensing spout 23 depressed thereby releasing fluid 22 through passageway 27 into the fluid expansion cavity 28 of back body half 15.

The container 21 in the position illustrated in FIGS. 7 and 8 is in its cocked position where the spring 45 is compressed and the dispensing spout 23 is coaxial but displace from the entry section 26. The container 21 is releasably restrained in its cocked position by a trigger element 6. The trigger element 6 is generally a flat member and includes a shaped latch portion hereafter referred to as trigger latch 39, holes 36 and 41 and a notch 40 and is shown best seen in FIGS. 7 and 11. The trigger element 6 is pivotably mounted on a pivot pin 35 and is slideably contained in slot 19 formed by the front and back body halves 15 and 16. The pivot pin holes 37 and 38 shown in FIG. 13, in body halves 15 and 16 provide location and support for the trigger elements' pivot pin 35 upon assembly of the two body halves. The trigger latch 39 engages the rim 24 of the container 21 when in the cocked position shown in FIG. 7. The spring 45 urged container 21 causes the trigger element to rotate counter-clockwise as shown in FIG. 7 around pivot pin 35 and therefore will be held against the interior body surfaces of the slot 19 and the container 21 thus retaining the container in its cocked, ready to trigger position.

Figure 10:
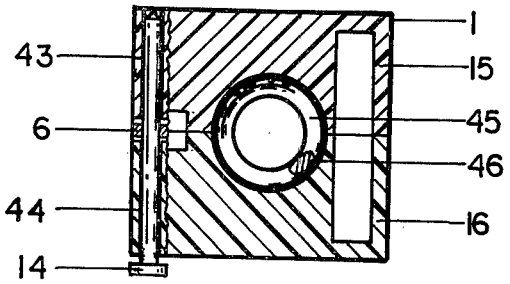
FIG. 10 is a horizontal sectional view along line E—E of FIG. 3.

The container 21 may be locked in its cocked position and the trigger element in its set position as shown in FIG. 7 by means of a safety pin 14 which passes through hole 44 in front body half 16, next through hole 41 in trigger element 6 and into hole 43 in back body half 15 as shown in FIG. 10. Holes 44, 41 and 43 are coaxially aligned on assembly and are pendicular to the plane of travel of the trigger element 6 such that when safety pin 14 is inserted into the holes 44, 41 and 43 the trigger element 6 is restrained from moving, thereby safely retaining the container 21 in its cocked position. When the device 1 is mounted on its right vertical side the safety pin can be entered from either front or back of the device.

Again referring to FIG. 7, a notch 40, is provided near the end of the trigger element 6. The looped cord 4 is connected at one end to the window sash 3 with fastener 5 and at its other end to the trigger element 6 by being looped over the end of the trigger element 6 and into the notch 40. The cord 4 is normally detached from the fastener 5 when the device 1 is placed in a non-triggerable condition by safety pin 14. When it is desired to place the device 1 into an area protecting triggerable condition upon the opening of window sash 3; the cord 4 is connected between fastener 5 and the trigger element 6 of device 1 as shown in FIG. 1 and the safety pin 14 is removed from the device 1 and hence trigger element 6. If the window sash 3 is now opened by a burglar or other intruder breaking window lock halves 9 and 10 from mutual engagement as shown in FIGS. 1 and 2, the cord 4 will be pulled in such a manner as to rotate the trigger element 6 clockwise in direction 34 moving the trigger latch 39 from engagement with the rim 24 of container 21 permitting said container 21 to be slideably pushed by spring 45 in direction 33 in the cavity 20 seating the dispensing spout 23 in entry section 26 thereby depressing dispensing spout 23 to cause a valved release of the pressurized fluid 22 through passageway 27 into the fluid expansion cavity 28. In such a position, as shown in FIGS. 11 and 12 the fluid is discharged from the container 21 into the cavity 28 to operate the sound emitting elements of the invention most clearly illustrated in FIGS. 8 and 12 in the non-triggered and triggered conditions respectively, the invention however, not being limited to the illustrated sound emitting means.

After the device has been triggered in the manner described herein above, the expanding fluid 22 in cavity 28 seeks to escape by pushing against the sound emitting diaphram 12 whose circumferential edge is securely held in the front body half 16 diaphram clamping cavity 32 by back body half 15 diaphram clamping projection 31 upon assembly of the two body halves 15 and 16. The diaphram 12 is pre-tensioned toward the front body half 16 by the conical diaphram projection 29 of back body half 15 so as to provide an opposing force to that which is exerted by the fluid 22 in cavity 28. When the fluid pressure exceeds the diaphram pressure exerted on projection 29 some fluid 22 escapes into rear sound cone 17 formed by projection 29 thereby reducing momentarily the pressure in cavity 28 thereby allowing diaphram 12 to seat against projection 29 again. As the pressure builds up again in cavity 28 the process is repeated. The pre-tensioning distance that projection 29 deflects diaphram 12, the thickness and material of the sound emitting diaphram 12, the fluid pressure of the aerosol container 21 are optimized to produce an oscillation of the diaphram at a particularly annoying audible frequency. The sound 13 emitted from the sound emitting diaphram is further mechanically amplified by the front and rear sound cones 18 and 17 and the sound continues until the fluid pressure in the device-cavity 28 and aerosol container 21 is too low to produce diaphram oscillations. The back body half 15 also has fluid escape ports 30 as part of its construction so that the fluid 22 being valved from cavity 28 past projection 29 into rear sound cone 17 by the sound emitting diaphram 12 has a low resistance path to the area ambient, particularly when the device 1 is mounted as shown in FIGS. 1 through 6 and 16.

After the device 1 has been triggered to emit sound in the manner described herein above, and when the device body halves are assembled using screws or snap-together projections, now shown, the body halves can be separated to replace the aerosol container 21, after restoring trigger element 6 to its cocked position and compressing spring 45 as depicted in FIG. 7. The device 1 shown in the drawings does not show the assembly method for the body halves 15 and 16 as a number of methods may be employed.

It is an important feature that the trigger element 6 be pivotally mounted and that the catch portion 39 thereof present a surface which will slide smoothly on the container rim 24 of the container 21 when the trigger element 6 is pulled. As a consequence the trigger element 6 may be easily withdrawn from engagement without substantial force. Yet when the trigger element 8 is positioned in engagement with the container rim 24 of the container 21, the element 6 serves to positively retain container 21 in its cocked position. Hence, substantially less force is required to trigger device 1 of the present invention than would be required if the container 21 were retained in its cocked position by means of a transversely extending trigger pin or the like, yet the container 31 is still safely retained in its locked position against accidental release by safety pin 14 passing through holes 41, 43 and 44. Although the device is shown in its preferred embodiment wherein a trigger element is rotationally mounted for mechanical advantage, the trigger element can also be made slideably mounted. A slideably mounted trigger element would require more force for release.

Yet another important feature is that the spring 45, located in spring cavity 46, be of substantial force so that the container dispensing spout 23 will seat in the entry section 26 with sufficient force to cause a seal between the two while operating the valve within the container 21 to release pressurized fluid 22 through the passageway 27 into the fluid expansion cavity 28 to oscillate diaphram 12 alternately from and back to the diaphram projection 29 thereby causing emission of an alarming sound 13 from the device 1.

The device may be returned to a non-triggerable state if it has not been triggered by re-inserting the safety pin through the safety pin holes and by removing one end of the trigger cord 4 from the fastener 5 on window sash 3 or other triggering means. It is also important in this embodiment that the discharging means is comprised of a projecting dispensing spout 23 for actuating the valved pressurized container 21, wherein, fluid discharge is caused when the projecting dispensing spout 23 is depressed. The body member 1' contains a fluid passageway 27 having a funnel shaped entry section 26 for engaging the projecting dispensing spout 23 and for forming a seal between the funnel shaped entry section 26 and the projecting dispensing spout 23, thereby permitting fluid flow through the dispensing spout 23 and the passageway 27 when the pressurized container is moved toward the entry section 26.

Figure 14:
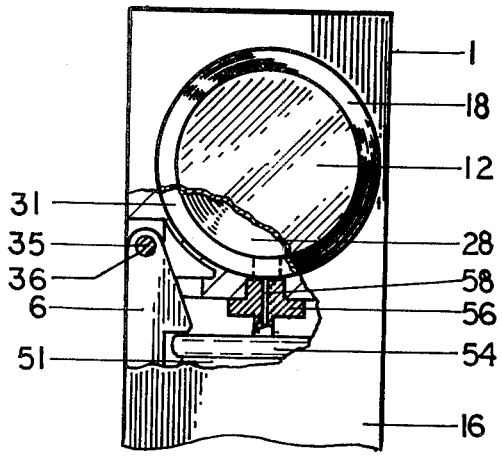
FIG. 14 is a partial vertical sectional view along line B—B of FIG. 4 except showing a second embodiment of the device.

A second embodiment of the invention is illustrated in FIG. 14. In this embodiment the basic structure is as previously described in the first embodiment and like numbers are used to indicate like or corresponding parts.

In this embodiment, the aerosol fluid container 21 shown in FIGS. 7 and 8, 11 and 12 having a dispensing spout 23 is replaced with a pressurized fluid container 51, shown in FIG. 14, having a dispensing recessed valve. Containers of the aerosol type with recessed dispensing valves are well known in the trade. The trigger element 6 engages the container rim 54 to retain the container similarly shown in FIG. 7 for the first embodiment. In addition the entry section 26 is replaced with a projection 56 in the entry section extending beyond the entry section toward the pressurized container 54 to engage the recessed valve, the recessed valve actuated upon depression to emit fluid into the passageway 58 both of which are coaxially aligned with fluid passageway 27 in back body half 15.

In this embodiment all elements function as described in the first embodiment with the following difference. The container 51 when released is discharged by the action of the porjection part 56 engaging with and depressing the recessed valve of the container 51, and fluid discharging through the fluid passageways 58 and 27 into fluid expansion cavity 28 to produce an alarming sound 13.

A third embodiment of the invention is illustrated in FIG. 15. In this embodiment the basic structure is as previously described in the first embodiment and like numbers are used to indicate like or corresponding parts.

In this embodiment, the pressurized gas container 21 shown in FIGS. 7 and 8, 11 and 12 of the first embodiment and having a dispensing spout 23, is replaced with a pressurized fluid container 61, shown in FIG. 15, having a pierceable section 63. Pressurized containers having pierceable sections are well known in the trade. In addition the entry section 26 of the first embodiment is replaced by piercing spout 66 having a piercing point 67, an O-ring seal 68 to effect a pressure seal between the pierceable section 63 and the piercing spout 66, and a fluid passageway 69 which is coaxially aligned with fluid passageway 27 in back body half 15.

In this embodiment, all elements function as described in the first embodiment with thee following difference. The container 61 when released by the trigger element 6 disengaging from container rim 64' is discharged by the action of the piercing point 67 of the projecting piercing spout 66 piercing the pierceable section 63 until the O-ring seal 68 provides a pressure seal between pierceable section 63 and pierceable spout 66 to allow fluid to flow through fluid passageways 69 and 27 into fluid expansion cavity 28 to produce an alarming sound 13.

A fourth embodiment of the invention is illustrated in FIGS. 16 and 17. In this embodiment the basic structure is as previously described but with different triggering means and like numbers are used to indicate like or corresponding parts.

In this embodiment, the trigger element 6 shown in FIGS. 2, 4, 6, 7, 8 and 10 through 15 is replaced by trigger element 76 having a shaped portion 77 but not requiring cord notch 40, cord 4 of fastener 5. The latter are replaced on window sash 3 or door frame 73 in FIGS. 16 and 17 by a latch plate 75 mounted with a screw 78 through latch plate screw hole 79 to door frame 73. The device 71 is mounted against the latch plate 75 as shown or other object so that if either the mounted device 71 or the latch plate 75 or other object move away from one another; the device will be triggered to emit an alarming sound 13 when the safety pin 14 has been removed from the device. The trigger element 76 shaped portion 77 is so designed that when either the latch plate or safety pin no longer holds the trigger element 76 the force exerted by the container 21 and therefore its rim 24 as a result of the force exerted by spring 45 upon container 21, the trigger element 76 is moved out of the way from its container retaining position by the container rim 24 in direction 34 similar to that shown in FIG. 11' thereby allowing the container 21 to be discharged in the same way as the first embodiment to produce an alarming sound 13.

The device 71 is shown in FIG. 16 in another application more suitable to this fourth embodiment. The device 71 is mounted on door 72 which is attached to door frame 73 mounted in wall 2 by hinges 74 and held in place also by door latch 80 so that the device is against latch plate 75 with only sufficient clearance to permit normal operation of the door 72. To render the device triggerable, the saftey pin 14 is removed, the trigger element 76 being held by the latch plate. A burglar or other intruder upon forcing open the door 72 will move the device 71 away from the latch plate 75 thereby releasing the trigger element 76 to rotate in direction 34 thereby triggering the device to emit an alarming sound 13.

If the device 71 has not been triggered, it can be returned to non-triggerable state by re-inserting the safety pin 14.

In addition to the previous described embodiments, anti-burglar sound emitting device may be made with a slideably mounted trigger element in place of a pivotably mounted trigger element 76. In this embodiment, the slideably mounted trigger element would engage the rim of the pressurized container; but being slideably mounted, the cord would be connected to the trigger element in a manner to pull the trigger element. A pull on the trigger element would cause disengagement from the rim of the pressurized container.

Although we have herein shown and described the invention in what we have conceived to be the most practical and preferred embodiments, it is recognized that departure may be made therefrom within the scope of our invention, which is not to be limited to the details disclosed herein, but is to be accorded the full scope of the claims so as to embrace any and all equivalent structures and devices.

We claim:

1. An anti-burglar sound emitting device for use with a pressurized container, the device comprising: a. a body member mounted on support means; b. means for slideably supporting said pressurized container in a first chamber in said body member; c. movable means in a second chamber in the body member for emitting sound by the use of a pressurized fluid, said movable sound emitting means comprising a closure wall for said second chamber d. a fluid passageway in said body member for directing a fluid from said pressurized container therethrough to said sound emitting means, said passageway having an entry section between said first and second chamber at one end of the body member; e. a spring biasing said container toward said entry section; f. means for selectively discharging fluid from said container into said entry section; g. means for releasably retaining said container displaced from said entry section, said retaining means including a trigger element, said trigger element being mounted for movement between an actuation position and a release position, said trigger element in said actuation position in engagement with said container to retain said container in a cocked position, said trigger element in said release position releasing the container from said cocked position whereby means on the container coacts with said pass ageway in the entry section in allowing discharge of fluid through said passageway to said sound emitting means to produce sound.

2. The anti-burglar sound emitting device of claim 1 in which the pressurized container comprises a pierceable section, means to provide a seal between the pierceable section and said entry section as the container is released, and means for puncturing said pierceable section, whereby fluid may be discharged.

3. The anti-burglar sound emitting device of claim 2 in which said means for puncturing comprises a projecting spout depending from said body member.

4. The anti-burglar sound emitting device of claim 1 wherein said pressurized container includes a dispensing valve actuated to permit fluid discharge therethrough upon depression thereof, said valve being actuated to a fluid release position through movement of said spring biased pressurized container acting to move said slideably mounted pressurized container to cause depression of said valve, thus causing discharge.

5. The anti-burglar sound emitting device of claim 4 wherein said valve pressurized container contains a projecting dispensing spout, said dispensing spout discharging fluid upon depression thereof, said entry section being funnel shaped for receiving said projecting spout on said container.

6. The anti-burglar sound emitting device of claim 4 wherein said valve pressurized container includes a recessed valve, said body member includes a projection in said entry section extending beyond said entry section toward said container to engage said recessed valve, said recessed valve activated upon depression thereof to emit fluid.

7. The anti-burglar sound emitting device of claim 1 wherein the fluid includes a chemical irritant, said chemical irritant being dispersed with the fluid as the device emits sound.

8. The anti-burglar sound emitting device of claim 1 wherein said trigger element is pivotably mounted for movement between said actuation position and said release position.

9. The anti-burglar sound emitting device of claim 1 wherein said trigger element is slideably mounted between said actuation position and said release position.

10. The anti-burglar sound emitting device of claim 1 wherein said trigger element in said actuation position is in shouldered engagement with said pressurized container to retain said container in a cocked position.

11. The anti-burglar sound emitting device of claim 1 wherein said trigger element in said actuation position is held in said actuation position by an external retaining means; said external retaining means including a latch plate mounted separate from said body member; the body member being movable between a first position in which the external retaining means retains the trigger element in its actuation position, and a second position in which the external retaining means allows the trigger element to move to its release position.

* * * * *